US006326878B1

(12) United States Patent
Liang

(10) Patent No.: US 6,326,878 B1
(45) Date of Patent: Dec. 4, 2001

(54) FUSE HOLDER

(76) Inventor: Shih-Tsung Liang, No. 10, Lane 31, Ta-Feng St., Lu-Chu Hsiang, Taoyuan County (TW)

( * ) Notice: Subject to any disclaimer, the term of this patent is extended or adjusted under 35 U.S.C. 154(b) by 0 days.

(21) Appl. No.: 09/495,380

(22) Filed: Feb. 1, 2000

(51) Int. Cl.[7] ..... H01H 85/22; H01R 13/68; H01R 4/48

(52) U.S. Cl. ..... 337/215; 337/214; 361/626; 361/642; 439/250; 439/830

(58) Field of Search ..... 337/186, 146, 337/215, 156, 189, 214, 216; 361/626, 642, 646, 837; 439/250, 366, 621, 830, 890, 835, 893

(56) References Cited

U.S. PATENT DOCUMENTS

| | | | | |
|---|---|---|---|---|
| D. 421,248 | * | 2/2000 | Baccei | D13/178 |
| 3,678,451 | * | 7/1972 | Bollver | 339/258 R |
| 3,896,353 | * | 7/1975 | Burton et al. | 317/103 |
| 3,927,929 | * | 12/1975 | Puetz | 339/258 F |
| 3,960,435 | * | 6/1976 | Bailey et al. | 339/186 R |
| 4,547,036 | * | 10/1985 | Keglewitsch et al. | 339/186 R |
| 4,801,278 | * | 1/1989 | Sappington | 439/746 |
| 4,921,450 | * | 5/1990 | Herbert | 439/621 |
| 5,167,541 | * | 12/1992 | Alves et al. | 439/622 |
| 5,328,392 | * | 7/1994 | Lin et al. | 439/833 |
| 5,618,209 | * | 4/1997 | Lin et al. | 439/621 |

FOREIGN PATENT DOCUMENTS

| | | | | |
|---|---|---|---|---|
| WO-96/29721-A1 | * | 9/1996 | (WO) | H01H/69/02 |

* cited by examiner

*Primary Examiner*—Leo P. Picard
*Assistant Examiner*—Anatoly Vortman
(74) *Attorney, Agent, or Firm*—Rosenberg, Klein & Lee

(57) ABSTRACT

A fuse holder includes a base panel, a plurality of conducting blocks mounted on the base panel, a plurality of electric wires respectively connected to the conducting blocks, and a plurality of cartridge fuses respectively connected in parallel between the conducting blocks, wherein each conducting block has at least one smoothly arched clamping strip, each clamping strip having two clamping flanges extending from two opposite sides and curved radially toward each other and defining a smoothly arched clamping mouth for holding one conducting blade of one cartridge fuse, and two notches respectively disposed between the clamping flanges and the respective conducting block, the clamping flanges each having a plurality of radially extended splits, which separate the corresponding clamping flange into a plurality of fingers.

3 Claims, 8 Drawing Sheets

FUSE HOLDER

BACKGROUND OF THE INVENTION

The present invention relates to fuse holders, and more particularly to such a fuse holder, which automatically compensates diameter difference of conducting blades of installed fuse, keeping installed fuse in positive connection to electric wires.

A regular fuse holder, as shown in FIG. 7, is generally comprised of a base panel 5, a cover 51 covered on the base panel 5, a plurality of conducting blocks 6 respectively mounted on the base panel 5 at two opposite sides, a plurality of electric wires 63 respectively fastened to the conducting blocks 6, and a plurality of cartridge fuse 3 respectively connected in parallel between the conducting blocks 6. The conducting blocks 6 each comprise a front extension 61, and a clamping plate 62 fixedly fastened to the front extension 61 by a screw 611 for receiving one conducting blade 31 of one cartridge fuse 3. The clamping plate 62 comprises a flat mounting base 621, and two curved clamping portions 622 extended from the flat mounting base 621 at two opposite sides for holding the conducting blade 31 at one end of one cartridge fuse 3. FIGS. 10 and 11 show another structure of fuse holder according to the prior art. This structure of fuse holder comprises a base panel 5, a plurality of conducting blocks 7 respectively mounted on the base panel 5, a plurality of electric wires 71 respectively connected to the conducting blocks 7, a plurality of clamping plates 8 respectively fastened to the conducting blocks 7 by respective screws 82, a cover 51 covered on the base panel 5, and a plurality of plug fuse 43 inserted through respective opening on the cover 51 and connected between the conducting blocks 431. The clamping plates 8 each comprise two curved clamping portions 81 for receiving one conducting blade 431 of one plug fuses 43. The aforesaid prior art fuse holders are still not satisfactory in function. The drawbacks of these prior art fuse holders are as follows:

(1) The curved clamping portions 622, 81 of the clamping plates 62, 8 may have different curvature due to different processing tolerance or material stress, causing installed cartridge fuse 3 or plug fuse 43 unable to be positively secured in position (see FIGS. 8 and 13).

(2) If the conducting blades 31 or 431 of the fuse 3 or 43 are deformed, the clamping portions 622 or 81 cannot fully compensate the deformation of the conducting blades 31 or 431, and the fuse 3 or 43 may be vibrated after installation.

SUMMARY OF THE INVENTION

The present invention has been accomplished to provide a fuse holder, which eliminates the aforesaid drawbacks. According to one embodiment of the present invention, the fuse holder comprises a base panel, a plurality of conducting blocks mounted on the base panel, a plurality of electric wires respectively connected to the conducting blocks, and a plurality of cartridge fuses respectively connected in parallel between the conducting blocks, wherein each conducting block has at least one smoothly arched clamping strip, each clamping strip having two clamping flanges extending from two opposite sides and curved radially toward each other and defining a smoothly arched clamping mouth for holding one conducting blade of one cartridge fuse, and two notches respectively disposed between the clamping flanges and the respective conducting block, the clamping flanges each having a plurality of radially extended splits, which separate the corresponding clamping flange into a plurality of fingers. According another embodiment of the present invention, the fuse holder is designed for the installation of a plug fuse, in which each conducting block comprises two parallel clamping flanges defining a flat, upwardly extended receiving space for receiving one conducting blade of a plug fuse, the clamping flanges each having a plurality of upwardly extended vertical splits, which divide the respective clamping flange into a plurality of upwardly extended fingers.

DETAILED DESCRIPTION OF THE PREFERRED EMBODIMENT

Figure 1:
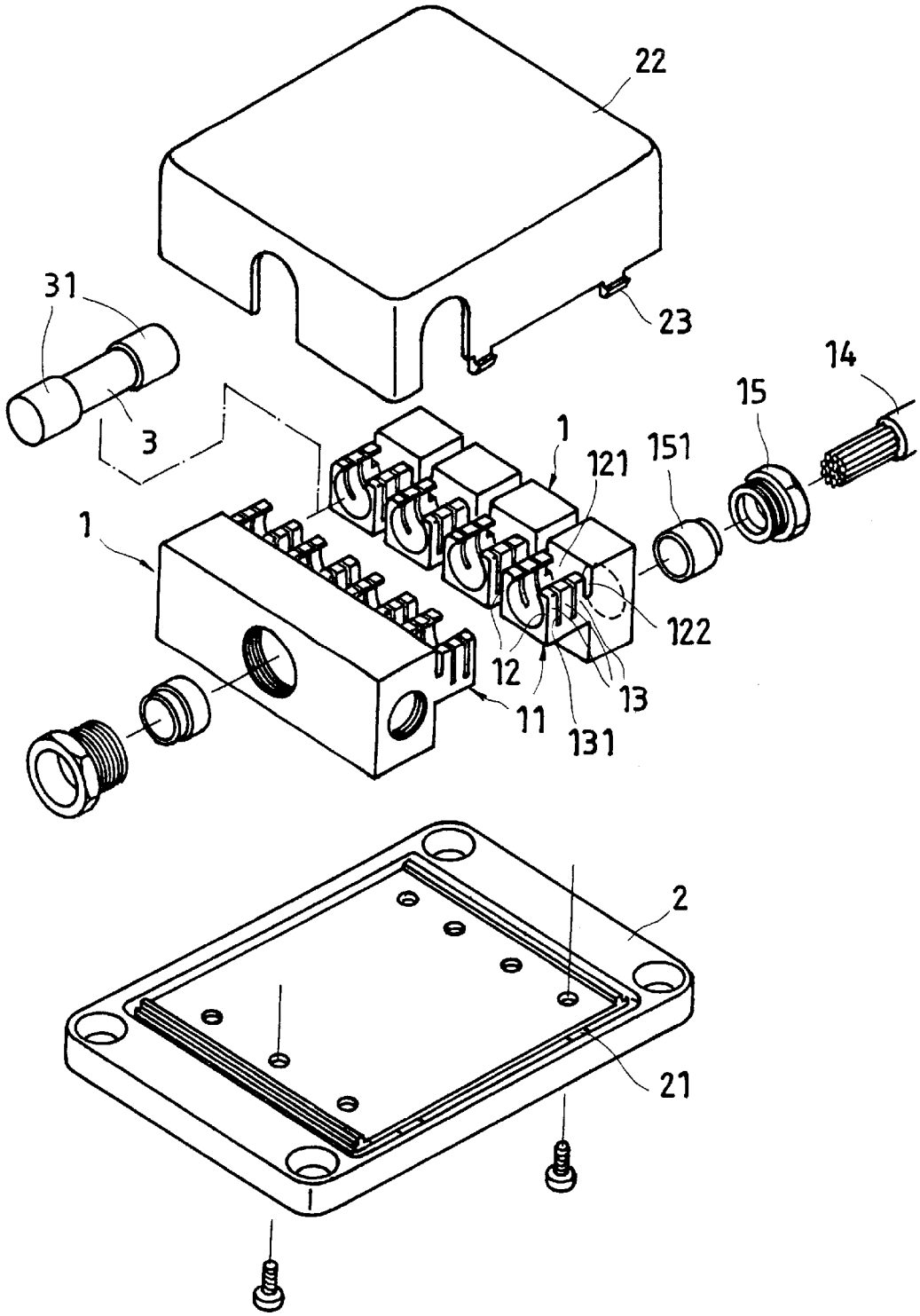
FIG. 1 is an exploded view of a fuse holder according to one embodiment of the present invention.
Figure 2:
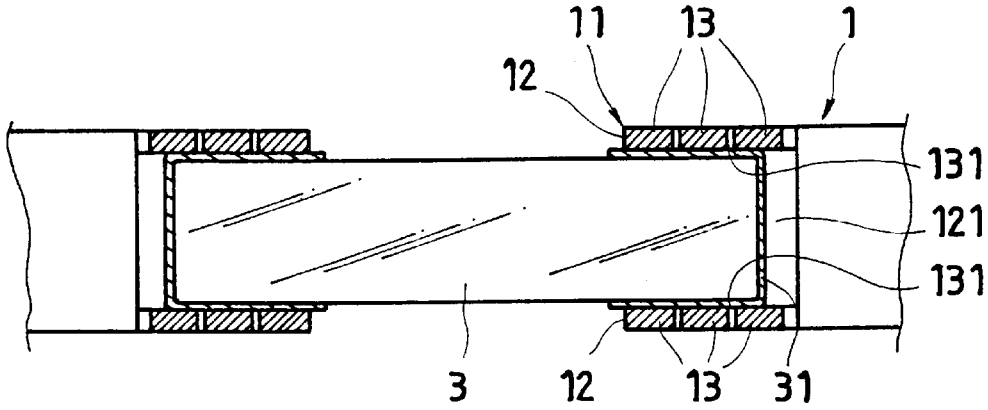
FIG. 2 is a sectional view showing a cartridge fuse connected between two conducting blocks according to the present invention.
Figure 3:
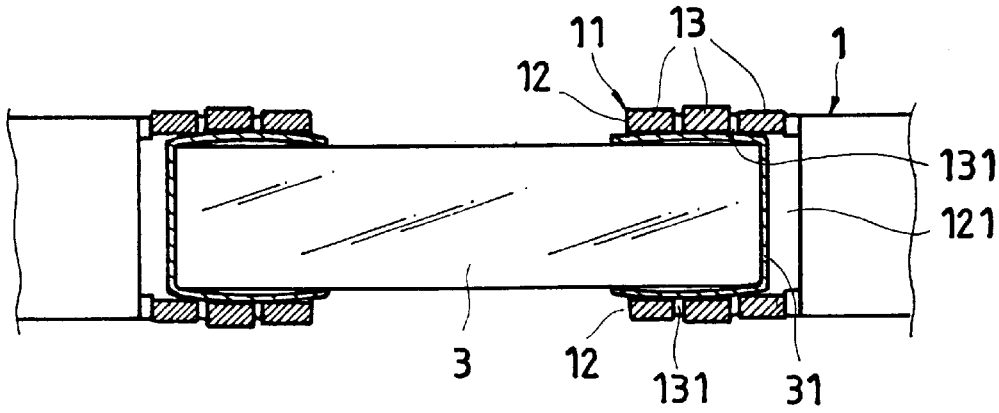
FIG. 3 is a sectional view showing deformed conducting blades of a cartridge fuse connected between two conducting blocks according to the present invention.

Referring to FIGS. from 1 through 3, a fuse holder in accordance with the present invention comprises a base panel 2, a plurality of conducting blocks I mounted on the base panel 2, a plurality of electric wires 14 respectively fastened to the conducting blocks 1, at least one cartridge fuse 3 connected between the conducting blocks 3, and a cover shell 22 covered on the base panel 2. A respective conductor binder 151 and lock screw 15 respectively fasten the electric wires 14 to the conducting blocks 1. Each conducting block 1 comprises at least one smoothly arched clamping strip 11. Each smoothly arched clamping strip 11 comprises two clamping flanges 12 extending from two opposite sides and curved radially toward each other and defining a smoothly arched clamping mouth 121 for holding one conducting blade 31 at one end of one cartridge fuse 3, and two notches 122 respectively disposed between the clamping flanges 12 and the respective conducting block 1 to increase springiness of the clamping flanges 12. The clamping flanges 12 each have a plurality of radially extended splits 131, which separate the corresponding clamping flange 12 into multiple fingers 13. Because the clamping flanges 12 each comprise a plurality of fingers 13 for holding down the conducting blade 31 of the respective cartridge fuse 3, deformation of the conducting blade 31 of the cartridge fuse 3 or deformation of the clamping strip 11 does not affect positive positioning of the conducting blade 31 in the smoothly arched clamping mouth 121 Further, the cover shell 22 comprises a plurality of bottom hooks 23 symmetrically disposed at two opposite sides and respectively hooked in respective hook holes 21 on the base panel 2.

Figure 4:
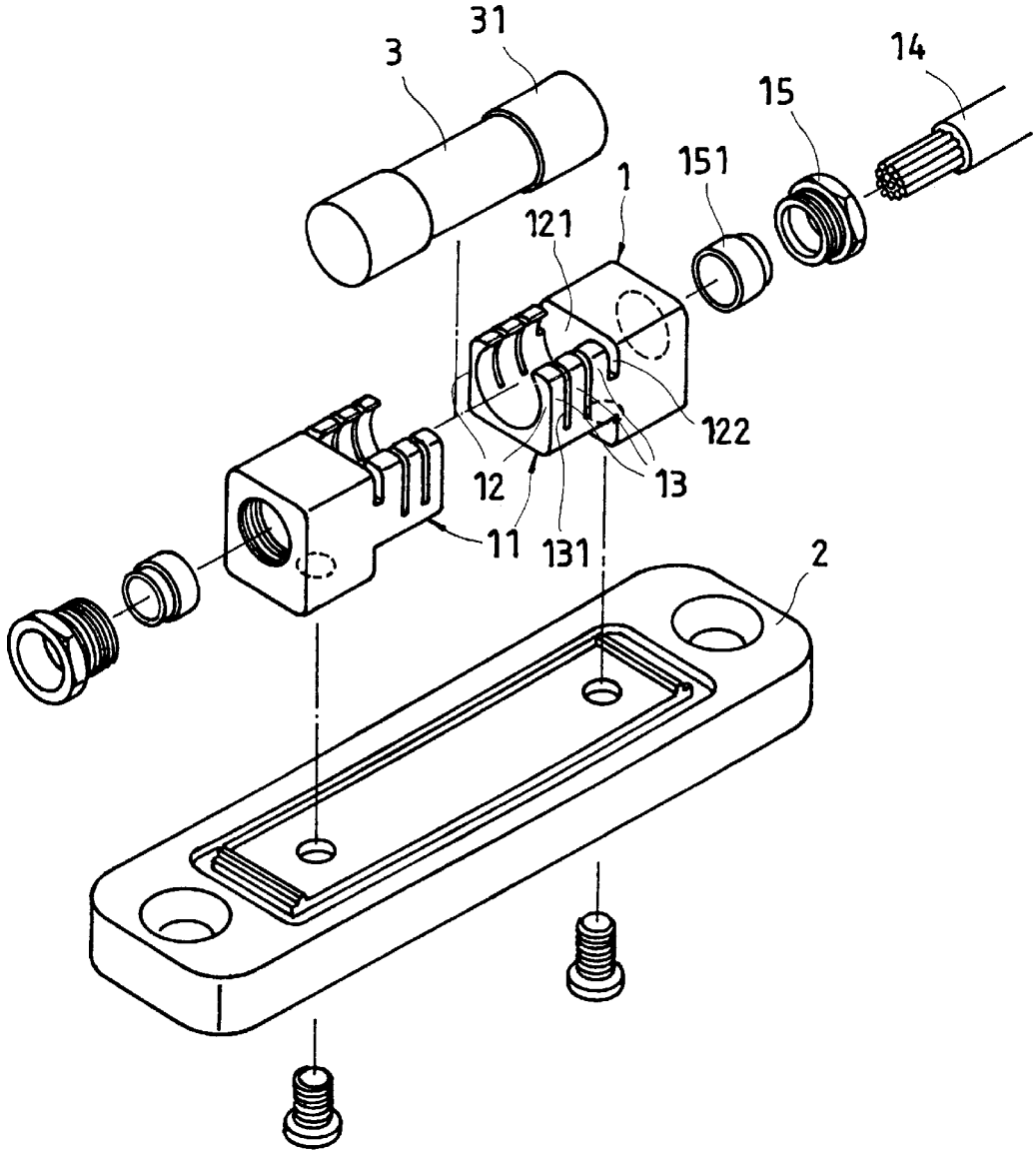
FIG. 4 is an exploded view of an alternate form of the fuse holder according to the present invention.

The embodiment shown in FIG. 1 is designed to hold multiple cartridge fuses 3 in parallel. FIG. 4 shows an alternate form of the fuse holder for holding one cartridge fuse 3.

Figure 5:
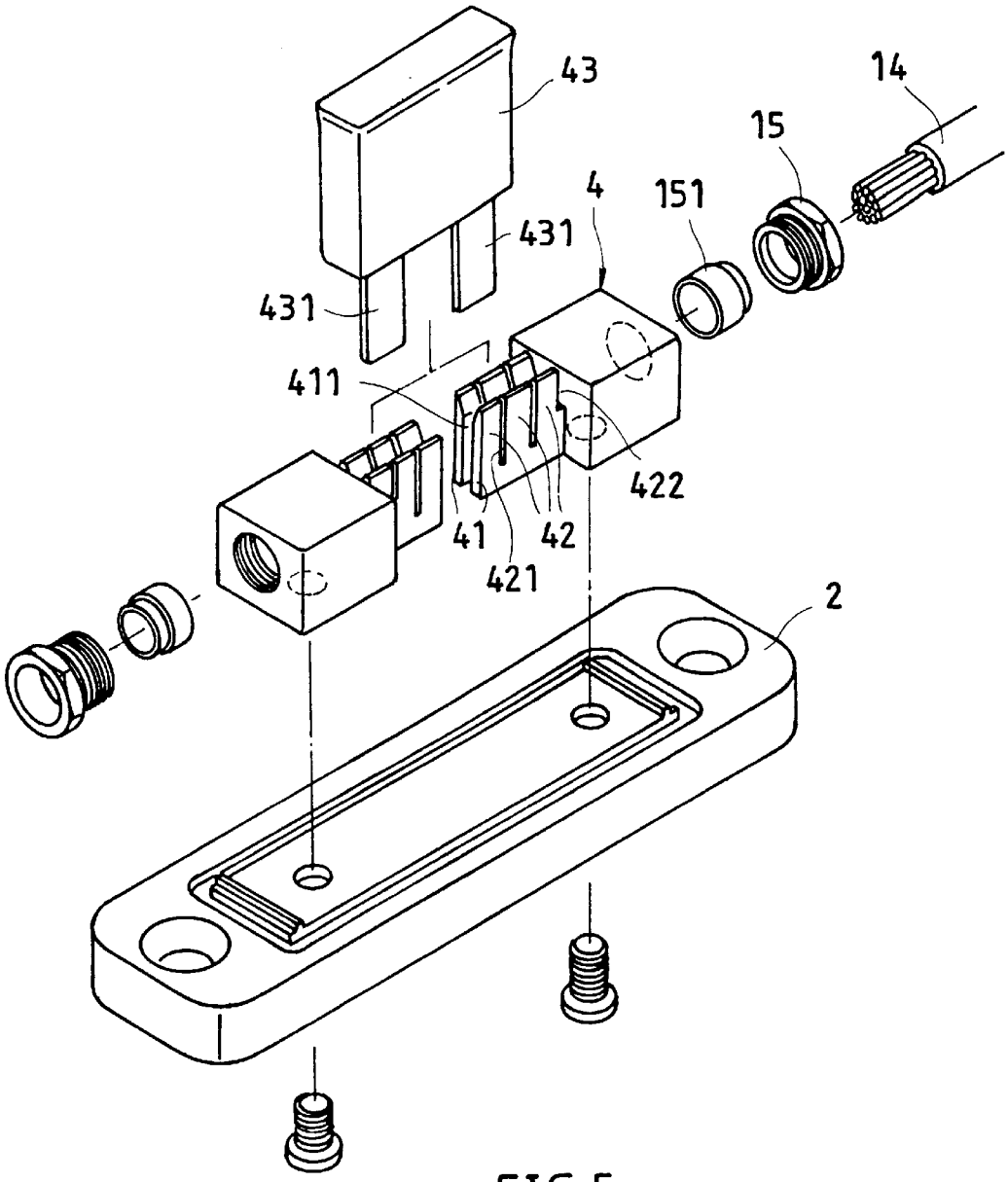
FIG. 5 is an exploded view of another alternate form of the fuse holder according to the present invention.

FIG. 5 shows another alternate form of the fuse holder according to the present invention. According to this alternate form, the fuse holder comprises a base panel 2, two conducting blocks 4 fastened to the base panel 2 at two opposite ends, two electric wires 14 (only one electric wire is shown) respectively fastened to the conducting blocks 4 with a respective conductor binder 151 and lock screw 15, and a plug fuse 43 connected between the conducting blocks 4. The conducting blocks 4 each comprise two parallel clamping flanges 41 defining a flat, upwardly extended receiving space 411 for receiving one conducting blade 431 of the plug fuse 43. Two notches 422 are respectively disposed between the clamping flanges 41 and the conducting block 4 to increase springiness of the clamping flanges 41. The clamping flanges 41 each have a plurality of upwardly extended vertical splits 421, which divide the respective clamping flange 41 into a plurality of upwardly extended fingers 42.

Figure 6:
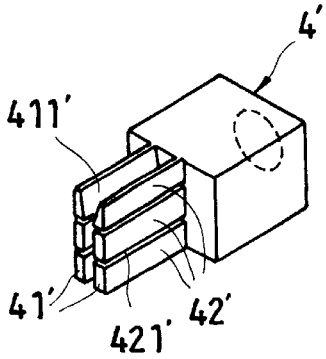
FIG. 6 is a perspective view of another alternate form of the conducting block for plug fuse for a fuse holder according to the present invention.
Figure 7:
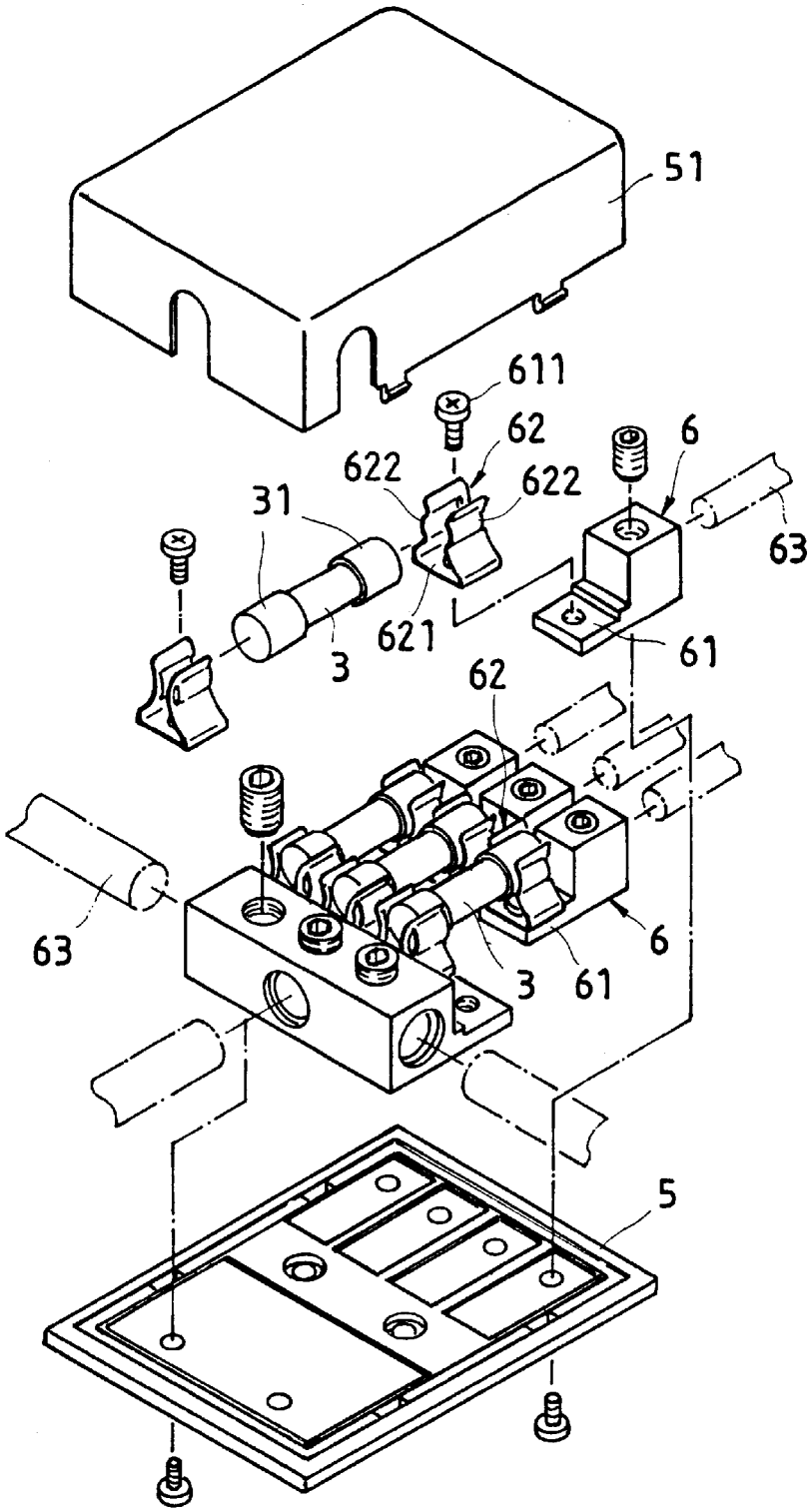
FIG.7 PRIOR ART
FIG. 7 is an exploded view of a fuse holder according to the prior art.
Figure 8:
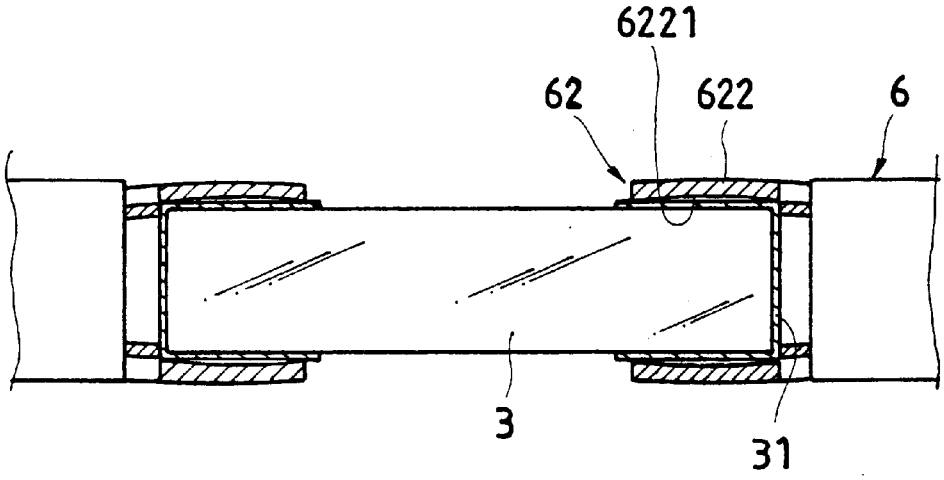
FIG.8 PRIOR ART
FIG. 8 illustrates a cartridge fuse installed in deformed clamping plates at conducting blocks according to the prior art.
Figure 9:
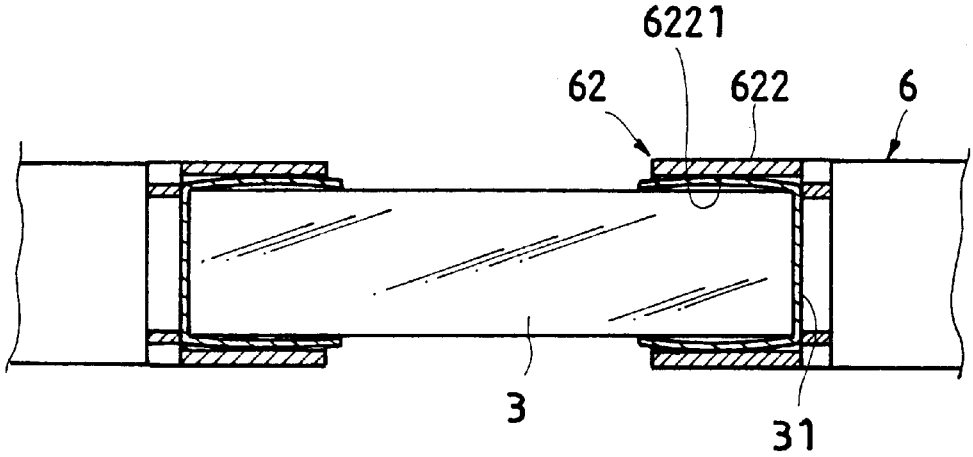
FIG.9 PRIOR ART
FIG. 9 illustrates deformed conducting blades of a cartridge fuse installed in clamping plates at conducting blocks according to the prior art.
Figure 10:
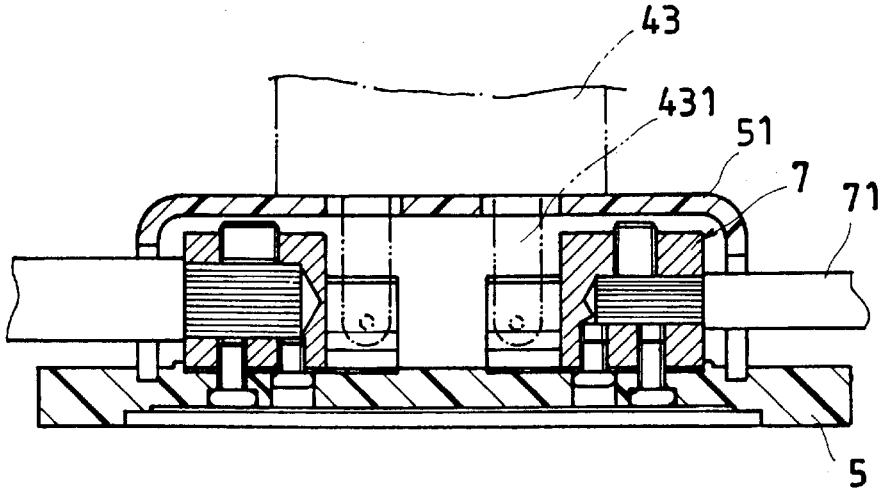
FIG.10 PRIOR ART
FIG. 10 is a sectional view of another structure of fuse holder according to the prior art.
Figure 11:
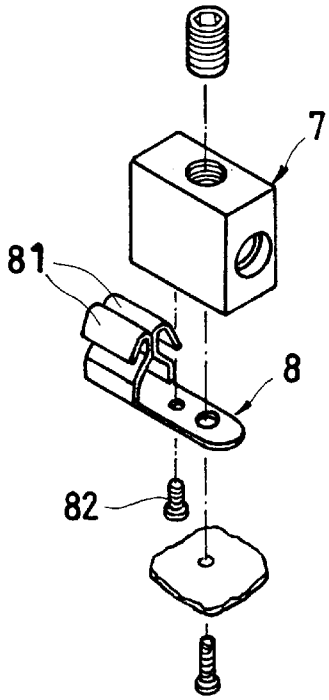
FIG.11 PRIOR ART
FIG. 11 is an exploded view of a part of the fuse holder shown in FIG. 10 showing the structure of the conducting block and the clamping plate.
Figure 12:
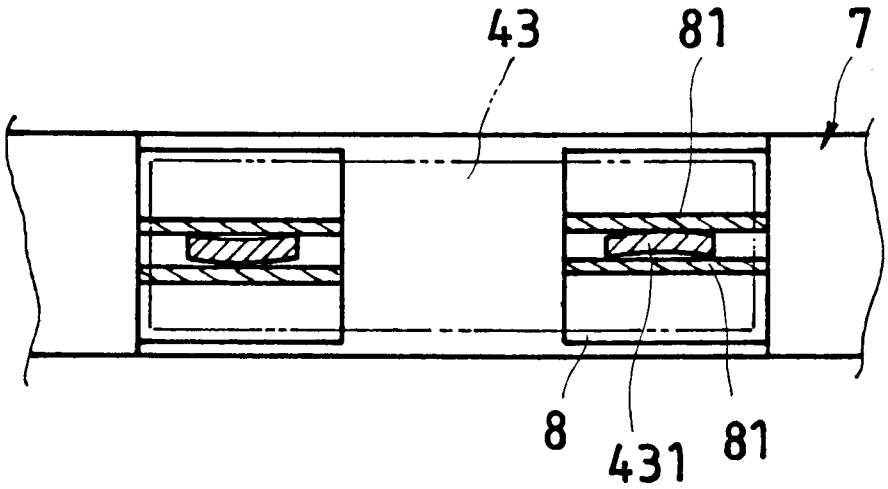
FIG.12 PRIOR ART
FIG. 12 illustrates deformed conducting blades of a plug fuse installed in clamping plates at respective conducting blocks according to the prior art.
Figure 13:
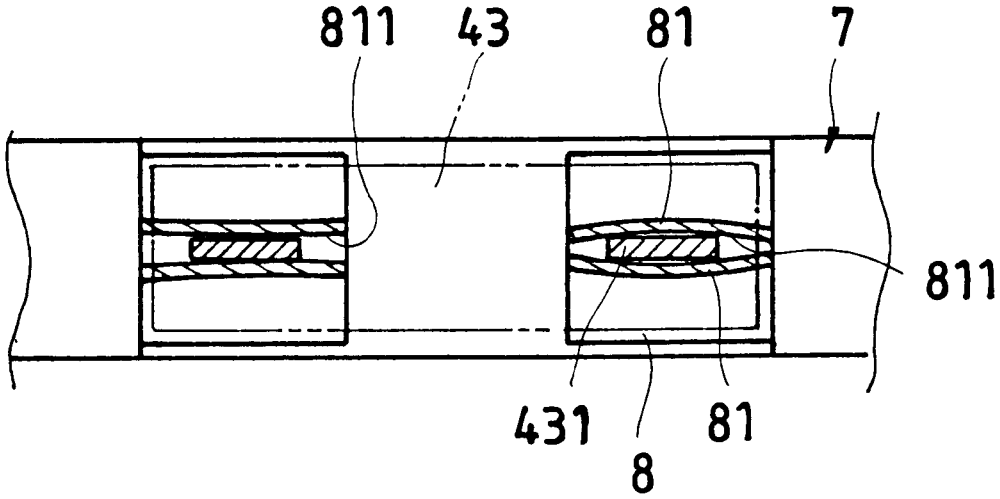
FIG.13 PRIOR ART
FIG. 13 illustrates conducting blades of a plug fuse installed in deformed clamping plates at respective conducting blocks according to the prior art.

Referring to FIG. 6, the conducting block 4' comprises two parallel clamping flanges 41', which define a flat, upwardly extended receiving space 411' for receiving one conducting blade 431 of the plug fuse 43 (see also FIG. 5). The clamping flanges 41' each have a plurality of forwardly extended horizontal splits 421', which divide the respective clamping flange 41' into a plurality of forwardly extended fingers 42'.

It is to be understood that the drawings are designed for purposes of illustration only, and are not intended for use as a definition of the limits and scope of the invention disclosed.

What the invention claimed is:

1. A fuse holder comprising a base panel, a plurality of conducting blocks mounted on said base panel;

a plurality of electric wires respectively fastened to said conducting blocks with a respective conductor binder and lock screw;

at least one cartridge fuse respectively connected between said conducting blocks; and a cover shell covered on said base panel;

wherein said conducting blocks each comprise at least one smoothly arched clamping strip, said at least one smoothly arched clamping strip each comprising two clamping flanges extending from two opposite sides and curved radially toward each other and defining a smoothly arched clamping mouth for holding one conducting blade at one end of one of said at least one cartridge fuse, and two notches respectively disposed between said clamping flanges and the respective conducting block, said clamping flanges each having a plurality of radially extended splits, which separate the corresponding clamping flange into a plurality of fingers.

2. A fuse holder comprising a base panel, a plurality of conducting blocks mounted on said base panel;

a plurality of electric wires respectively fastened to said conducting blocks with a respective conductor binder and lock screw;

at least one plug fuse respectively connected between said conducting blocks; and a cover shell covered on said base panel;

wherein said conducting blocks each comprise two parallel clamping flanges defining a flat, upwardly extended receiving space for receiving one conducting blade of one of said at least one plug fuse, said clamping flanges each having a plurality of upwardly extended vertical splits, which divide the respective clamping flange into a plurality of upwardly extended fingers.

3. A fuse holder comprising a base panel, a plurality of conducting blocks mounted on said base panel;

a plurality of electric wires respectively fastened to said conducting blocks with a respective conductor binder and lock screw;

at least one plug fuse respectively connected between said conducting blocks; and a cover shell covered on said base panel;

wherein said conducting blocks each comprise two parallel clamping flanges defining a flat, upwardly extended receiving space for receiving one conducting blade of one of said at least one plug fuse, said clamping flanges each having a plurality of forwardly extended horizontal splits, which divide the respective clamping flange into a plurality of forwardly extended fingers.

* * * * *